United States Patent [19]

Willis

[11] 4,407,629

[45] Oct. 4, 1983

[54] LIFTING APPARATUS FOR DOWN-HOLE TUBULARS

[75] Inventor: Clyde A. Willis, Wichita Falls, Tex.

[73] Assignee: Walker-Neer Manufacturing Co., Inc., Wichita Falls, Tex.

[21] Appl. No.: 172,543

[22] Filed: Jul. 28, 1980

[51] Int. Cl.[3] ..... E21B 19/14

[52] U.S. Cl. ..... 414/745; 414/22; 175/52; 175/85; 212/222

[58] Field of Search ..... 414/745, 747, 22; 175/85, 52; 52/116, 118, 119; 292/57; 212/222, 182, 183, 185, 187, 188

[56] References Cited

U.S. PATENT DOCUMENTS

| | | | |
|---|---|---|---|
| Re. 26,284 | 7/1960 | O'Neill et al. . | |
| 156,238 | 10/1874 | Squyer | 292/57 |
| 3,158,213 | 8/1960 | O'Neill et al. . | |
| 3,734,208 | 5/1973 | Otto | 175/52 |
| 3,778,940 | 12/1973 | Blecken | 52/116 |
| 3,977,480 | 8/1976 | Hilding | 175/85 |
| 4,102,094 | 7/1978 | MacKinnon | 52/116 |
| 4,109,800 | 8/1978 | Howard et al. | 414/745 |

*Primary Examiner*—Trygve M. Blix
*Assistant Examiner*—Stephen P. Avila
*Attorney, Agent, or Firm*—Hume, Clement, Brinks, Willian & Olds, Ltd.

[57] ABSTRACT

An improved boom for a drill rig is described which includes two rotatably mounted clamps which are rotatable between a side loading position, to facilitate loading and unloading in the horizontal position, and a central position, in which a clamped tubular is aligned with the drilling axis when the boom is in the vertical position. An automatic hydraulic sequencing circuit is provided to automatically rotate the clamps into the side loading position whenever the boom is pivoted with a down-hole tubular positioned in the clamp. In this position, the clamped tubular is aligned with a safety plate mounted on the boom to prevent a clamped tubular from slipping from the clamps. A safety frame is formed between the tower of the drill rig and the vertical boom by a slidable bolt mounted on the tower and an annular receiving member mounted on the boom to receive the end of the bolt. This boom also includes an improved pivoting linkage which facilitates the transport of the rig.

20 Claims, 10 Drawing Figures

ACCUMULATOR
84

CLAMP
16
98
ACCUMULATOR
100
96
85
24
BOOM UP
88
86
CLAMP
ROTATION
CYL.
92
90
102
BOOM
DOWN
104
94
BOOM
CYL.
26
CLOSE
OPEN
80
82
PRESSURE
RETURN
MANUALLY
CONTROLLED
VALVE TO RAISE
AND LOWER BOOM 14
MANUALLY
CONTROLLED
VALVE TO OPEN
AND CLOSE CLAMPS 16

LIFTING APPARATUS FOR DOWN-HOLE TUBULARS

BACKGROUND OF THE INVENTION

The present invention relates to an improved apparatus for handling oil well and water well tubulars and rods, including but not limited to drill pipe, drill collars, well casing, production tubing, sucker rods, pump column pipe, and the like, all of which tubulars, pipes, and rods are referred to herein simply as "down-hole tubulars." More particularly, this invention relates to such a handling apparatus which exhibits improved safety of operation and ease of use and setup.

In the past, drill rigs with top head rotary drives have on occasion been provided with pivotably mounted pipe booms for raising and lowering lengths of down-hold tubulars between the horizontal position, in which they are transported and stored, and the vertical position, in which they are aligned with the drilling axis of the rig to be joined to other lengths. Such booms facilitate handling, assembly and disassembly of down-hole tubular strings.

SUMMARY OF THE INVENTION

The present invention is directed to an improved apparatus for handling down-hole tubulars in a drill rig, which is safe to operate and which can be easily operated, set-up for use, and partially disassembled when necessary to move the drill rig.

An object of this invention is to provide a drill rig mounted boom having rotatable clamps which can be positioned to at least one side of the boom to facilitate the loading and unloading of down-hole tubulars into and from the clamps.

Another object of this invention is to provide a boom with such rotatable clamps wherein the clamp can be rotated to bring a clamped down-hole tubular into alignment with the drilling axis of the drill rig.

Another object of this invention is to provide a boom with rotatable clamps, wherein the boom further includes means for raising and lowering the boom with a clamped tubular rotated out of the plane of the drilling axis, and means for automatically rotating the clamps to bring the clamped tubular into alignment with the drilling axis after the tubular has been raised substantially into a vertical position.

Another object of this invention is to provide an apparatus for handling down-hole tubulars which includes a boom and means for capturing a clamped tubular between the boom and the tower of the drill rig when the boom is in the vertical position, adjacent the drill rig tower.

Another object of this invention is to provide an improved linkage between a drill rig and a boom, which linkage is easily stored for transport without removing the lower portion of the boom or the linkage from the drill rig and which is therefore readily taken down and set up when the drill rig is transported.

These and other objects of the invention are accomplished by providing an improved drill rig boom having clamps for handling down-hole tubulars. According to a first feature of the invention, a pipe boom includes rotatably mounted clamps for holding down-hole tubulars. These clamps are rotated into a first position to facilitate side loading and unloading of down-hole tubulars between the clamps and a substantially horizontal support structure such as a pipe rack or a truck bed.

Once the down-hole tubular is loaded, the clamps can be rotated to a second position in which the clamped down-hole tubular is alligned with the drilling axis of the drill rig, i.e. the centerline of the drill string. Preferably, means are provided for automatically rotating the clamps into the second position whenever the boom is moved without a tubular clamped in the clamps, and for automatically rotating the clamps into the first position whenever the boom is moved while a tubular is clamped in place.

According to a second feature of the invention, means are provided for guiding the boom into an alligned position with respect to the drill rig tower when the boom is raised to the vertical position. This guiding means can be configured in a number of ways to perform one or more of the following functions. First, the guiding means can be configured to capture a vertically oriented tubular between the boom and the tower of the drill rig when the boom is in the vertical position, thereby preventing clamped tubulars from falling out of the tower in the event of clamp failure. Second, the guide means can include a sleeve mounted on the tower, a bolt slidably mounted in the sleeve, and an annular receiving member mounted on the boom to receive the bolt when the boom is in the vertical position adjacent the tower. In this way, the guiding means can be made to retract quickly and easily in order to reduce the roading height of the rig when the tower is lowered to the horizontal position. Third, the guiding means can be configured to transfer torques exerted on a clamped tubular from the clamps, via the boom, to the tower, thereby preventing twisting of the boom. This feature of the guiding means is particularly important when the boom is used in connection with a top head drive, power swivel, or the like, to make up and break out strings of down-hole tubulars.

According to a third feature of the invention, the boom includes a safety plate mounted on the boom to restrain downward, longitudinal movement of a clamped tubular if it should slip in the clamps. Preferably, this safety plate is used with the rotatably mounted clamp described above and the safety plate is positioned such that the plate does not restrict longitudinal movement of a clamped tubular which is aligned with the drilling axis of the rig.

According to a fourth feature of the invention, the boom is formed in two sections which can be readily assembled and disassembled. The lower boom section is pivotably mounted to the drill rig and is positioned by a linkage which includes a tension member and two compression members, one of which includes a hydraulic cylinder. This linkage is arranged such that, when fully assembled, the hydraulic cylinder operates to raise and lower the boom. As the boom is in the raised position, the linkage is preferably moved to a raised position as well. Because the upper portion of the boom is removable, the rig can be kept to an acceptable height and a lower weight for transport. In addition, because the lower portion of the boom can be kept permanently mounted to the drill rig, set-up time and take down time are reduced. Preferably the upper boom is held to the lower boom by two pins to further speed assembly and disassembly of the boom.

The principal advantages of this invention are improved speed and safety of operation. The capturing means and the safety plate cooperate to confine clamped down-hole tubulars and to prevent a tubular which has slipped from the clamps from escaping and falling. The automatically rotated clamp provides the further advantage that a clamped tubular is maintained in alignment with the safety plate until the boom reaches the vertical position and the clamped tubular is restrained by the capturing means. The boom of this invention also provides increased safety because a length of tubular can be raised or lowered with a minimum of manual contact with the tubular. This keeps operating personnel away from the moving tubulars, and reduces the number of personnel needed to operate the rig.

The rotatable clamp of this invention provides the further advantage that the clamp can be rotated for easy loading and unloading. The boom of this invention is well suited for automated or semi-automated pipe handling systems, especially those in which gravity loading and unloading is used.

The improved linkage of this boom provides the advantage of quick set-up and stowing of the boom. The pivot connection between the boom and the drill rig need not be disassembled in order to stow the boom for transport, and reassembly is therefore relatively quick.

The invention, together with further objects and attendant advantages will be best understood by reference to the following detailed description taken in connection with the accompanying drawings.

DETAILED DESCRIPTION OF A PREFERRED EMBODIMENT

Figures 1, 2, 7:
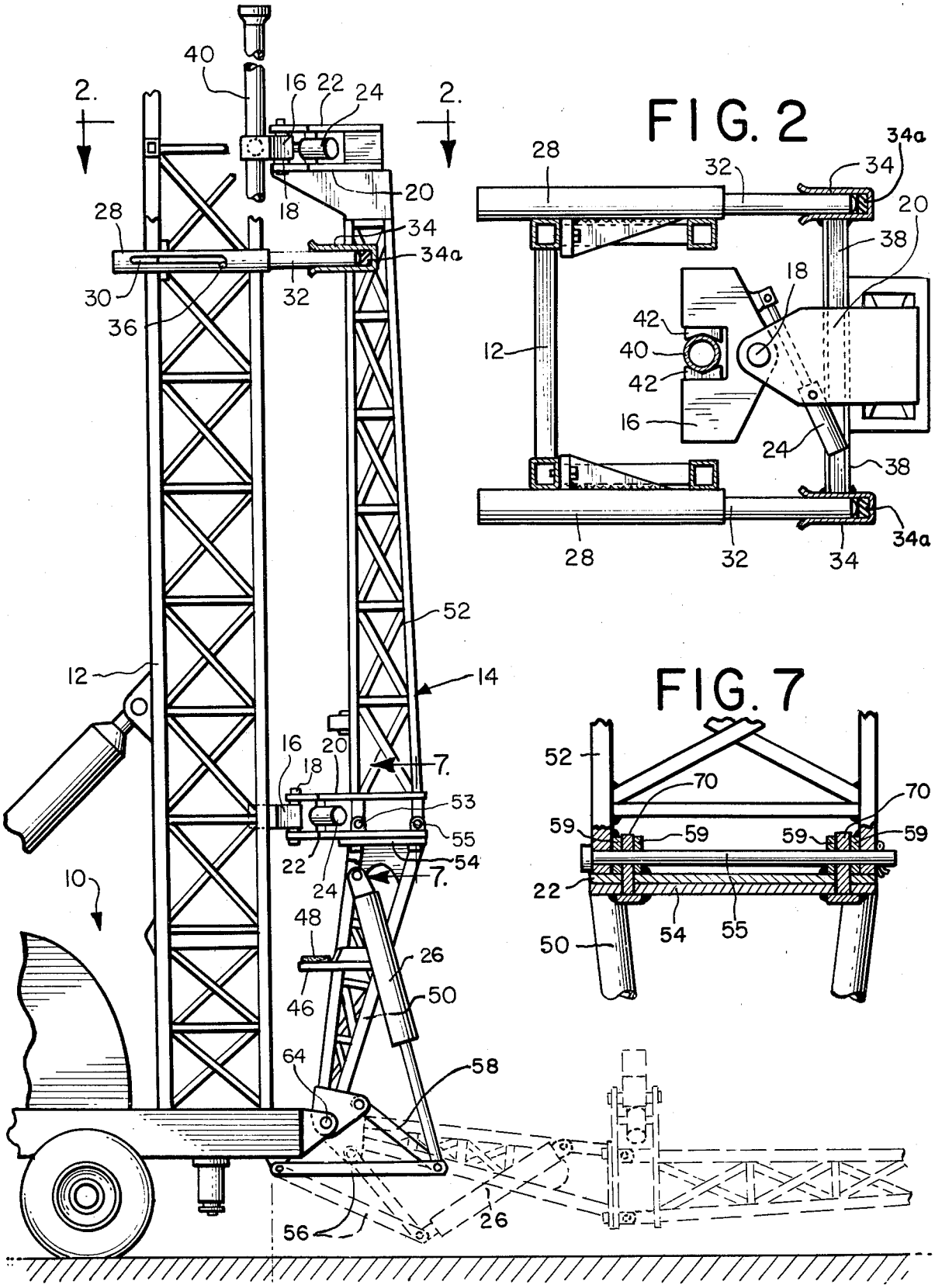
FIG. 1 is an elevational view of a mobile drill rig including a preferred embodiment of the boom of this invention pivoted to the vertical position.
FIG. 2 is a cross-sectional view taken along line 2—2 of FIG. 1 showing a clamp rotated to align the clamped down-hole tubular with the drilling axis of the drill rig.
FIG. 7 is a cross-sectional view of a portion of the boom taken along line 7—7 of FIG. 1.

Referring now to the drawings, FIG. 1 shows a mobile, transport mmounted drill rig 10 including a tower 12 and a boom 14 pivotably mounted to the rig 10. The boom is pivotable between a vertical position adjacent the tower 12 (shown in solid lines), and a horizontal position (partially shown in dotted lines).

Two clamps 16 for clamping and holding downhole tubulars such as a length of drill pipe 40 are rotatably mounted on the boom 14 in co-linear alignment. Each clamp 16 is mounted on an axis 18 which is pivotably supported between two spaced, parallel plates 20,22. A hydraulic cylinder 24 is trunnion mounted between the plates 20,22, and the clamp 16 such that contraction and elongation of the cylinder 24 rotates the clamp 16 with respect to the boom. Each clamp 16 includes a pair of opposed clamping members 42 which are positioned by hydraulic cylinders (not shown) to clamp and hold the drill pipe 40.

A hollow sleeve 28 is welded to each side of the tower 12, perpendicular to the boom 14 when in the vertical position shown. Each of these sleeves 28 is preferably formed from $4\frac{1}{2}$ inch drill pipe, and each contains a longitudinal slot 30 which is provided with a downwardly projecting angle as shown. Positioned in each sleeve 28 is a pointed bolt 32. Each bolt is slideable in the respective sleeve 28 between an extended position (as shown) in which the pointed end of the bolt 32 extends outwardly toward the boom 14, and a retracted position (not shown) in which the bolt 32 retracts into the sleeve 28 to a point where the pointed end of the bolt 32 is substantially flush with the edge of the tower 12 adjacent the boom 14. Each bolt 32 includes a pin 36, mounted to the bolt 32, which projects through the slot 30 and locks the bolt 32 in the extended position when positioned in the downwardly projecting angle of the slot 30 as shown.

Figure 4:
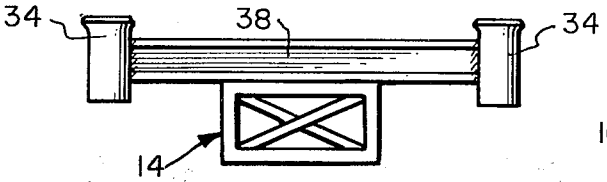
FIG. 4 is a cross-sectional view taken along line 4—4 of FIG. 3.

The boom 14 is provided with a pair of annular receiving members 34 mounted to the boom 14 via a gussetted I-beam 38. The receiving members are funnel shaped and are positioned to align with and receive the extended bolts 32 when the boom is in the vertical position shown. The receiving members 34 are preferably equipped with elastomeric pads 34*a* or other shock absorbing means to help insulate tower 12 from shocks resulting from suddenly stopping boom 14 and tubular 40 as same are rotated into tower 12 about pins 64. FIG. 4 shows a cross-section of the boom 14 including the receiving members 34. As best seen in FIG. 2, the sleeves 28, bolts 32, and receiving members 34 cooperate to achieve four objectives: first, to confine a clamped drill pipe 40 when the boom 14 is in the vertical position, thereby preventing the drill pipe 40 from tipping away from the tower if it should fall from the clamps 16; second, to stop, align and stabilize boom 14 with respect to the tower 12 so as to assure accurate alignment and make up of drill pipe 40 with a swivel saver sub (not shown); third, to help stabilize boom 14 when high torque is applied by a power swivel or top head drive (not shown) to make up or break out drill pipe 40 to or from the swivel saver sub; and fourth, to cusion the shock of stopping boom 14 and tubular 40 as same are rotated into tower 12 about pins 64.

The boom 14 is also provided with a safety plate 46 which is securely welded to the boom 14 and braced by gussets. A resilient pad 48 of rubber or other shock absorbent materials is secured to the upper face of the safety plate 46. This safety plate is positioned to obstruct longitudinal movement of the pipe 40 down through the clamps 16 when the clamps are rotated in the position shown in FIG. 5. This prevents a clamped pipe from slipping, whether due to operator error equipment failure, out of the clamps 16 while it is being raised or lowered. This resilient plate does not interfere with the downward movement of the clamped pipe 40 once the clamps 16 have been rotated to bring the pipe 40 into alignment with the drilling axis of the drill rig, as shown in FIG. 2. At this point the safety plate is no longer needed, for the bolts 32 and the tower 12 cooperate to restrain a vertical tubular. Furthermore, the safety plate 46 would interfere with the makeup of a string if it projected too near to the drilling axis.

Figure 3:
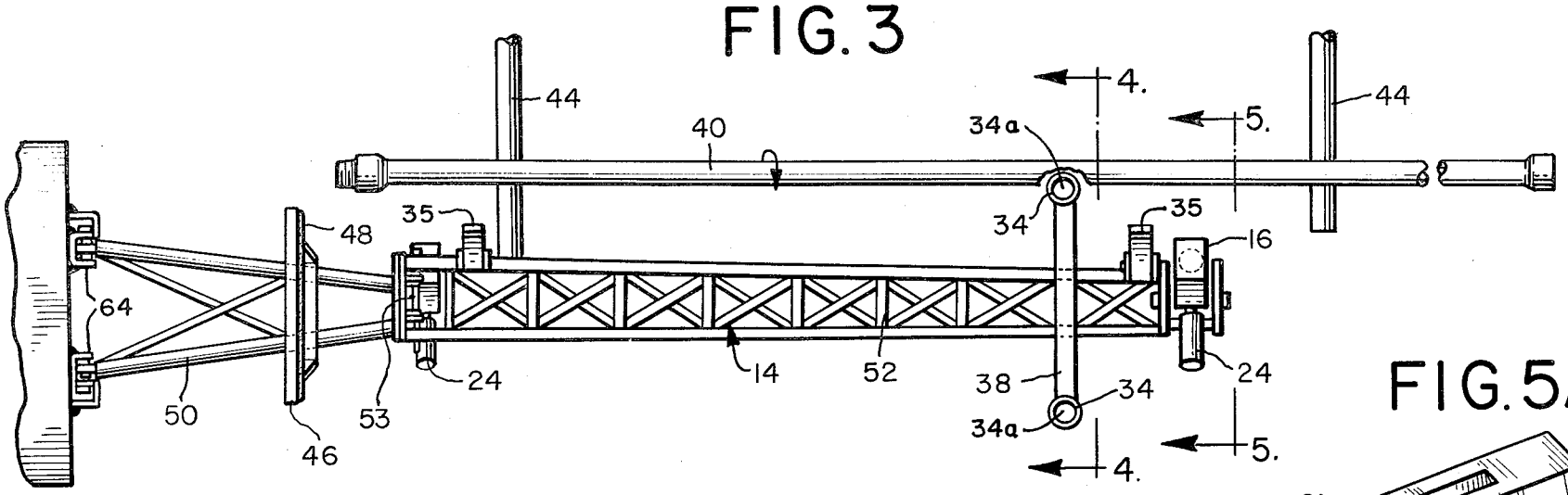
FIG. 3 is a plan view of a portion of the rig of FIG. 1 showing the boom in the horizontal position.
Figure 5A:
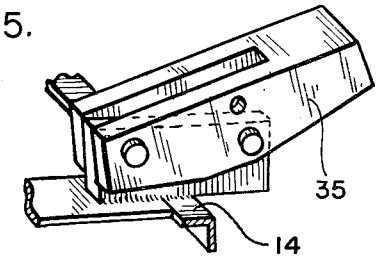
FIG. 5*a* is a partial perspective view of one of the two ramps of the boom of FIG. 1.
Figure 5:
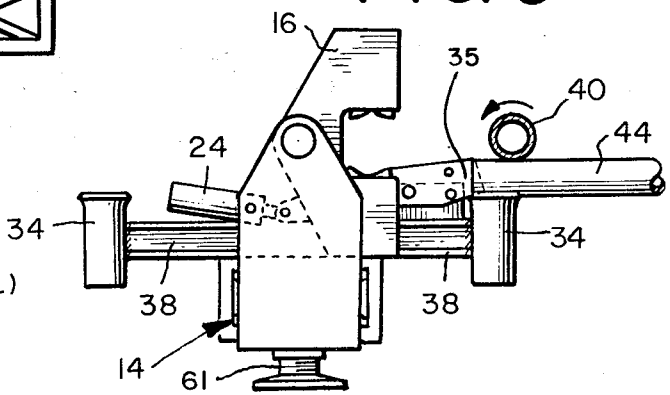
FIG. 5 is an end view taken along line 5—5 of FIG. 3 showing a clamp rotated to load a down-hole tubular.

FIGS. 3 and 5 show a length of drill pipe 40 being loaded into the clamps 16 of the boom 14. The pipe 40 is supported on a pair of conventional pipe racks 44, and the clamps 16 are rotated to the side for easy loading. In the illustrated clamp, the pipe 40 enters the clamp 16 by moving along a loading axis, which is horizontal when the clamp 16 is rotated as shown in FIG. 5. This facilitates gravity loading and unloading, as the ends of the pipe racks 44 next to pipe clamps 16 need to be raised or lowered only an inch or so to cause down-hole tubulars to roll into or out of clamps 16. Such slight tilting of pipe racks toward or away from boom 16 is easily accomplished by means known to those familiar with the art of rotary drilling.

Pipe boom 16 is equipped with an adjustable boom stop 61 whereby the height of clamps 16 can be adjusted to the height of pipe racks 44. When properly adjusted by the boom stop 61, pipe racks 44 and pipe clamps 16 are in the respective elevations shown in FIG. 5. Thus, pipe 40 can be rolled into or away from clamps 16 by gravity simply by changing very slightly the elevations of ends of pipe racks 44 that are farthest away from pipe clamps 16. The boom includes two ramps 35 which can be adjusted to either a loading position, in which a ramp is created which slopes down to the clamp, or an unloading position, in which a ramp is created which slopes down to the rack. A perspective view of one of the ramps 35 mounted to the boom 14 is shown in FIG. 5*a*. Alternatively, adjustable slope ramps 35 may be mounted on clamps 16.

Figure 8:
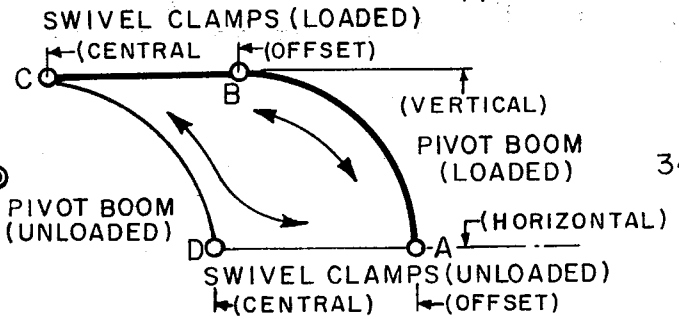
FIG. 8 is a diagrammatic representation of the operation of the boom of FIG. 1.

The boom 14 includes means for automatically sequencing the rotation of the clamps 16 for maximum safety and ease of loading and unloading pipe clamps 16. FIG. 8 schematically shows the sequence of events. Briefly, if the boom is loaded with a length of clamped tubular, the clamps 16 are automatically placed in the offset position shown in FIG. 5 whenever the boom moves into or away from the vertical position. The clamps are moved from the offset position to the central position (shown in FIG. 2) after the boom reaches the vertical position when a tubular is being raised and before the boom leaves the vertical position when a tubular is being lowered. In this way the clamped tubular is always aligned with the safety plate when it is being either raised or lowered and, also, is caused to be property oriented with respect to pipe racks when horizontal.

When the boom 14 is pivoted without a tubular in the clamps 16, the sequence is reversed. That is, the clamps are moved from the offset to the central position before the boom is raised, and from the central position to the offset position after the boom is lowered. This properly places the clamps 16 in the central position when the boom 14 is raised to clamp and lower a tubular suspended on the drilling axis.

Figure 9:
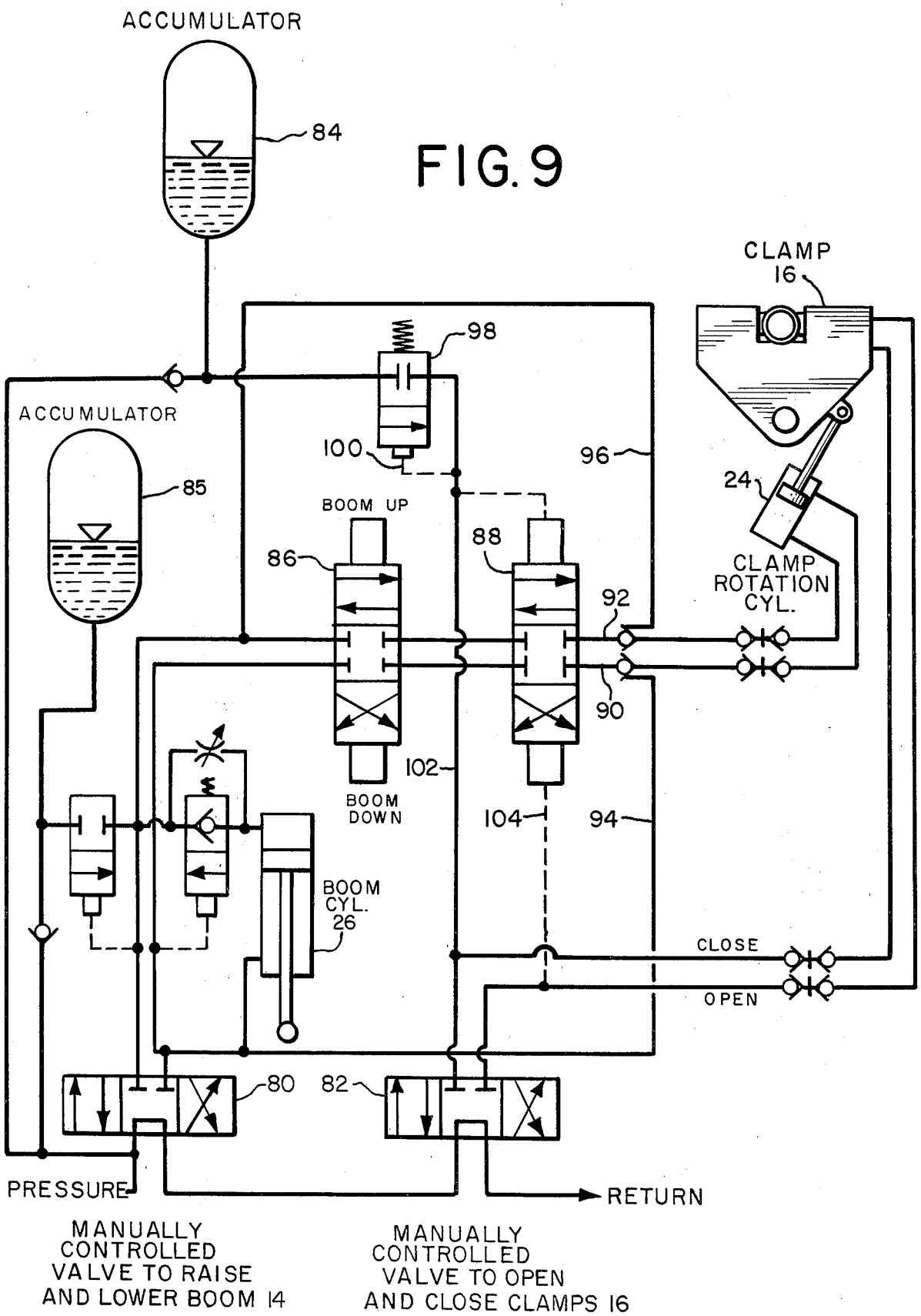
FIG. 9 is a schematic representation of the hydraulic circuit of the boom of FIG. 1.

FIG. 9 presents a schematic representation of the hydraulic circuit of this preferred embodiment that automatically sequences the rotation of the clamp 16 as described above. FIG. 9 schematically shows the boom cylinder 26, the clamp rotation cylinder 24 and the clamp 16. Also included in the circuit is a manually controlled valve 80 for controlling the cylinder 26 to raise and lower the boom 14. Manually controlled valve 82 controls the clamp 16 to close and open the clamp. These two valves are coupled in series between a source of pressurized hydraulic fluid (designated "Pressure") and a low pressure tank (designated "Return"). For example, when the valves 80,82 are in the positions shown, both the cylinder 26 and the clamp 16 are static. Moving valve 80 to the right causes the cylinder 26 to extend and the boom 14 to lift, while moving valve 80 to the left causes the cylinder 26 to retract and the boom 14 to lower. Similarly, moving valve 82 to the right closes the clamp 16 and moving the valve 82 to the left opens the clamp 16.

Also included are accumulators 84,85, a valve 86 responsive to boom position, and a valve 88 responsive to the state of the clamp 16 (open or closed). Valves 90,92 are pilot-operated check valves which block flow into the cylinder 24 except when pressure is applied on lines 94,96, respectively. Valve 98 blocks flow out of the accumulator except when pressure is applied on line 100.

In operation, the valve 86 is moved to the lower position when the boom 14 is in the vertical position, to the upper position when the boom 14 is in the horizontal position, and it remains in the position shown when the boom is in the intermediate position. This ensures that the clamp 16 does not rotate when the boom 14 is in an intermediate position.

When valve 82 is moved to the right, the clamp 16 is closed and pressure is applied via line 102 to open the valve 98 and to move the valve 88 into the lower position. This ensures that the accumulator 84 supplies pressure to hold the clamp 16 closed in the event of a drop in the pressure of the supply. Furthermore, with the valve 88 in the lower position, when valve 80 is moved to the right, the clamp 16 is rotated into the offset position for side loading when the boom is down, is held in this position as the boom is raised, and automatically rotates to the central position when the boom reaches the vertical position. When tubulars are being lowered and the clamp is closed while the boom is in the vertical position, once valve 80 is moved to the left the clamp 16 is rotated from the central position to the offset position while the boom is in the vertical position, and then the boom is lowered with the clamp in the offset position.

The situation is reversed when the clamp 16 is opened and pressure on line 104 raises the valve 88 into the upper position. In this case, the clamp is held in the central position as the boom is pivoted, and the clamp can only be rotated to the offset position after the boom has reached the horizontal position.

In the foregoing discussion the terms left, right, upper, and lower are used in connection with the valves 80,82 86,88 only to designate directions as shown on the drawing of FIG. 9, and these terms are not to be construed as having any physical significance.

Figure 6:
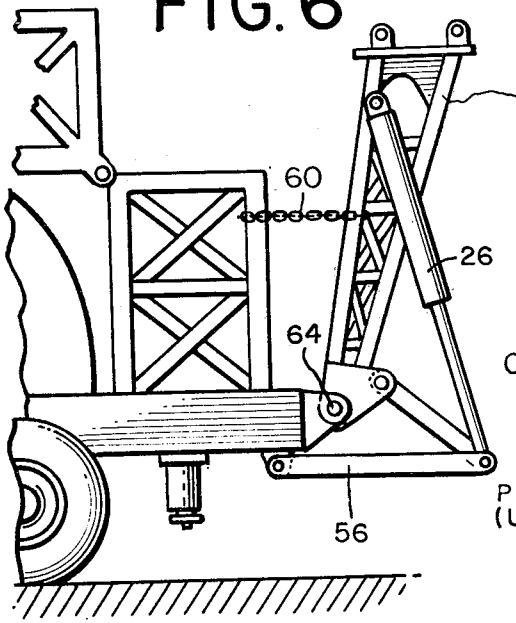
FIG. 6 is an elevational view of a portion of the rig of FIG. 1 showing the boom partially disassembled and stowed for drill rig transport.

FIGS. 3, 6 and 7 show another feature of the invention which facilitates set-up and stowing of the boom 14. The boom 14 is made up of an upper boom section 52 and a lower boom section 50. The lower boom section 50 is pivotably connected to the drill rig 10 at two points via a pin and a clevis. A plate 54 forms one end of the lower boom section 50. The upper boom section 52 also includes a lower plate 22 which can be mounted to the plate 54 by fasteners such as a combination of lugs and pins.

As shown in FIG. 7, the lower boom section 50 preferably includes a pair of lower spaced lugs 70 which are positioned to mate with spaced clevis lugs 59 mounted on the upper boom section 52. A pin 53 is placed through matching openings in the lugs 70 and the clevis lugs 59 to secure the upper boom section 52 firmly to the lower boom section 50. As shown in FIG. 1, a total of two pins 53, 55 are used to secure the upper boom section 52 to the lower boom section. Preferably, the pin 55 locks spaced clevis lugs mounted on the lower boom section and mating lugs mounted on the upper boom section. Preferably, the upper pin 53 and lower pin 55 are solid steel rods approximately 3 inches in diameter.

Of course, an alternate approach is simply to bolt the upper and lower boom sections together. However, the use of pins and lugs is faster and more reliable, and it eliminates the problem of differential torques among several bolts. Furthermore, the pin and lug arrangement of this preferred embodiment is easier to assemble in the field, since only one set of lugs needs to be aligned at a time. Preferably, the pins 53,55 are slightly tapered in order to facilitate allignment and are provided with enlarged heads so they can be hammered into place.

A tension member 58 is pivotably mounted to each pin 64, and is pivotably connected to two compression members 26,56, one of which 26 includes a hydraulic cylinder in this embodiment. In other embodiments the hydraulic cylinder can be placed between the rig 10 and the tension member 58. In operation, the cylinder 26, the tension member 58, and the compression member 56 cooperate such that elongation and shortening of the cylinder 26 causes the boom to pivot. As the boom rises from the horizontal to the vertical position as shown in FIG. 1, the compression member 56 pivots to a near horizontal position. Here it should be noted that the boom is supported from the rig entirely by the linkage members 56,58 28 and the pivot 64. No additional contact is made with the ground to support the weight of the boom as it is pivoted between the horizontal and the vertical positions. This is an additional feature of the invention which further reduces set-up and take-down time.

Referring now to FIG. 6, the boom 14 can be stowed as follows. First, the upper boom section 52 is removed from the lower boom section 50 while in the horizontal position by removing the pins 53,55. The upper boom section 52 is then transported separately from the rig 10, as in a pipe truck for example. Then the lower boom section 50 is raised with the cylinder 26 to the vertical position and then chained in position with a chain 60 to complete the stowing of the boom. As the lower boom section 50 was raised, the compression member 56 automatically pivoted into an upper position which is removed from ground level adequately to permit highway transportation of the rig. Thus, the lower boom section 50 need not be dismounted from the rig in order to prepare the rig for highway travel. Since lower boom section 50 is always powered it can be used as a rudimentary crane for lifting and positioning such heavy items as blowout preventors, slips, large drill bits, and the like. The boom can be quickly and easily returned to service merely by removing the chain, lowering the lower boom section 50 to the horizontal position, and then securing the upper boom section 52 to the lower boom section 50 with the pins 53,55. Thus, the boom 14 can be quickly returned to service and the rig 10 is always complete with at least a rudimentary materials handling boom.

As shown in FIG. 6, the tower 12 is made in two pivoted parts, the upper of which is lowered to a horizontal position when the rig is to be transported. The lower section of the boom 50 does not extend above the height of the lowered tower 12 and thus does not present an additional obstruction to bridges and the like under which the rig must pass. Similarly, the bolts 32 retract to a position which does not extend substantially above the top of the tower 12 when it is lowered to the horizontal position.

From the foregoing it should be apparent that an improved pipe handling apparatus has been described which requires little or no manual contact with a down-hole tubular either to raise the tubular to build up a string of tubulars, or to dissassemble a string of tubulars and lower a tubular. This apparatus includes important safety features to restrain a tubular if it should slip, either when moving in the boom or when being rotated, when in the vertical position, into a centerline of the drill string. Furthermore, the apparatus is readily placed in a compact configuration suitable for rig transport.

Of course, it should be understood that various changes and modifications to the preferred embodiment described herein will be apparent to those skilled in the art. Such changes and modifications can be made without departing from the spirit and scope of the present invention, and without diminishing its attendant advantages. It is, therefore, intended that such changes and modifications be covered by the following claims.

I claim:

1. In a drill rig including a tower for supporting a string of down-hole tubulars and a boom pivotably mounted to the rig adjacent the tower to move between a parallel to the tower, said boom including a clamp for clamping and holding a down-hole tubular, the improvement comprising:

a support member mounted to the tower;

a bolt slidably mounted to the support member and movable between a first position, in which the bolt is retracted toward the support member, and a second position, in which the bolt is extended away from the support member on the side of the tower facing the boom;

means for locking the bolt in the second position;

a blocking member mounted to the boom and aligned with the bolt such that the bolt substantially abuts the blocking member when the boom is in the vertical position substantially parallel to the tower;

said support member, bolt, and blocking member positioned to provide a safety frame between the boom and the tower at a level adapted to restrain the movement of vertically positioned down-hole tubulars between the tower, the boom, and the frame.

2. The improvement of claim 1 wherein the support member is a sleeve.

3. The improvement of claim 2 wherein the locking means includes a slot in the sleeve and a projecting arm on the bolt which extends through the slot.

4. The improvement of claim 1 or 2 wherein the bolt, when in the first position, retracts toward the support member such that the bolt does not extend substantially beyond the edge of the tower nearest the boom.

5. The improvement of claim 1 or 2 wherein the blocking member is an annular member aligned such that the bolt, when locked in the second position, fits into the blocking member when the boom is in the vertical position to align the boom with respect to the tower and to transmit torque from the boom to the tower.

6. The improvement of claim 1 or 2 further including means for defining a stop position for the boom such that the vertical position of the boom is precisely controlled to align down-hole tubulars clamped in the boom with a pre-determined vertical axis.

7. The improvement of claim 6 wherein the means for defining a stop position includes shock absorbing means for reducing the peak acceleration of the boom when the boom reaches the stop position such that peak loads applied to the tower in stopping upward movement of the boom are reduced.

8. The improvement of claim 7 wherein the shock absorbing means comprises a resilient member positioned to be interposed between the support member and the blocking member when the boom is in the vertical position.

9. In a drill rig including a tower for supporting a string of down-hole tubulars, and a boom pivotably mounted to the rig adjacent the tower to move between a horizontal position and a vertical position, substantially parallel to the tower, said boom including a clamp for clamping and holding a down-hole tubular, the improvement comprising:

a sleeve mounted to the tower;

a bolt slidably positioned in the sleeve and movable between a first position, in which the bolt is retracted into the sleeve, and a second position, in which the bolt is extended out of the sleeve on the side of the tower facing the boom;

means for locking the bolt in the second position; and an annular receiving member mounted to the boom and aligned with the bolt such that the bolt fits within the receiving member when the boom is in the vertical position substantially parallel to the tower;

said bolt, sleeve, and receiving member positioned to provide a safety frame between the boom and the tower positioned at a level adapted to restrain the movement of vertically positioned down-hole tubulars between the tower, the boom, and the frame, said receiving member and bolt cooperating to align the boom with respect to the tower and to transmit torque from the boom to the tower.

10. The improvement of claim 9 wherein the locking means includes a slot in the sleeve and a projecting arm on the bolt which extends through the slot.

11. In a drill rig including a tower for supporting a string of down-hole tubulars, and a boom pivotably mounted to the rig adjacent the tower to move between a horizontal position and a vertical position, substantially parallel to the tower, said boom including upper and lower clamps for clamping and holding a down-hole tubular, the improvement comprising:

means for rotatably mounting the clamps on the boom so as to rotate about an axis substantially parallel to the boom;

a safety plate mounted to the boom aligned to prevent a clamped down-hole tubular from slipping longitudinally in the clamp beyond said safety plate as the boom moves between the horizontal and vertical positions when the clamp is in a first position, said safety plate positioned to prevent the clamped tubular from slipping out of the upper clamp;

means for rotating the clamps between the first position, in which the clamped tubular is aligned with the safety plate, and a second position, in which the clamped tubular is moved out of alignment with the safety plate and into alignment with the drilling axis of the rig when the boom is in the vertical position; and means for automatically controlling the rotating means such that the clamps are automatically rotated into the first position whenever a down-hole tubular is being held in the clamp and the boom is being pivoted between the horizontal and vertical position.

12. The improvement of claim 11 wherein each of the clamps defines a respective loading axis along which tubulars are moved as they are loaded into the clamps and the clamps are aligned such that, with the clamps rotated to the first position and the boom in the horizontal position, the loading axes are oriented substantially horizontally to facilitate loading and unloading the clamps.

13. The improvement of claim 12 wherein the second clamp position is rotated by about 90 degrees with respect to the first clamp position.

14. The improvement of claim 11 further including means for capturing a clamped tubular between the tower and the boom when the boom is in the vertical position such that a barrier is created between the boom and the tower which acts to positively prevent a vertical tubular from falling away from the tower.

15. The improvement of claim 14 wherein the capturing means includes a sleeve mounted on the tower, a bolt slidably mounted in the sleeve, means for locking the bolt in an extended position in which the bolt protrudes from the sleeve towards the boom, and an annular receiving member mounted to the boom to receive the bolt when the boom is in the vertical position.

16. In a drill rig including a tower for supporting a string of down-hole tubulars, and a boom pivotably mounted to the rig adjacent the tower to move between a horizontal position and a vertical position, substantially parallel to the tower, said boom including a clamp for clamping and holding a down-hole tubular, the improvement comprising:

means for rotatably mounting the clamp on the boom so as to rotate about an axis substantially parallel to the boom;

means for rotating the clamp between a first position in which the clamp is oriented with its loading axis aligned in a substantially horizontal direction when the boom is in the horizontal position to facilitate loading and unloading the clamp, and a second position in which the clamp is oriented to align a clamped tubular with the drilling axis of the rig when the boom is in the vertical position and;

means for guiding a horizontally oriented down-hole tubular to roll from a storage position in a direction aligned with the substantially horizontal loading axis of the clamp in the first position in order to roll the tubular into the clamp.

17. The improvement of claim 16 further including a safety plate mounted on the boom and positioned to limit longitudinal motion of a clamped tubular when the clamp is in the first position, such that longitudinal motion of the clamped tubular is not obstructed when the clamp is in the second position.

18. The improvement of claim 16 or 17 further including means for capturing a clamped tubular between the tower and the boom when the boom is in the vertical position such that a barrier is created between the boom and the tower which acts to positively prevent a vertical tubular from falling away from the tower.

19. In a drill rig including a tower for supporting a string of down-hole tubulars, and a boom pivotably mounted to the rig adjacent the tower to move between a horizontal position and a vertical position, substantially parallel to the tower, said boom including upper and lower clamps for clamping and holding a down-hole tubular, the improvement comprising:

means for rotatably mounting the clamps on the boom so as to rotate about an axis substantially parallel to the boom;

a safety plate mounted to the boom aligned to prevent a clamped down-hole tubular from slipping longitudinally in the clamps beyond said safety plate as the boom moves between the horizontal and vertical positions when the clamp is in a first position, said safety plate positioned to prevent the clamped tubular from slipping out of the upper clamp;

means for rotating the clamps between the first position, in which the clamped tubular is aligned with the safety plate, and a second position, in which the clamped tubular is moved out of alignment with the safety plate and into alignment with the drilling axis of the rig when the boom is in the vertical position;

means for automatically controlling the rotating means such that the clamps are automatically rotated into the first position whenever a down-hole tubular is being held in the clamp and the boom is being pivoted between the horizontal and vertical position; and means for capturing a clamped tubular between the tower and the boom when the boom is in the vertical position such that a vertical tubular is prevented from falling away from the tower, said capturing means comprising a sleeve mounted on the tower, a bolt slidably mounted in the sleeve, means for locking the bolt in an extended position in which the bolt protrudes from the sleeve towards the boom, and an annular receiving member mounted to the boom to receive the bolt when the boom is in the vertical position.

20. The improvement of claim 19 wherein the boom is mounted to move in a plane which includes the drilling axis of the drill rig, wherein each of the clamps defines a respective loading axis; wherein the loading axes are positioned in the plane when the clamps are in the second position, and wherein the loading axes are oriented substantially horizontally when the clamps are in the first position and the boom is in the horizontal position.

* * * * *

UNITED STATES PATENT AND TRADEMARK OFFICE

CERTIFICATE OF CORRECTION

PATENT NO. : 4,407,629

DATED : October 4, 1983

INVENTOR(S) : Clyde A. Willis

It is certified that error appears in the above-identified patent and that said Letters Patent is hereby corrected as shown below:

Column 8, Claim 1, line 27, please delete "a parallel", and substitute therefor --a horizontal position and a vertical position, substantially parallel--.

Signed and Sealed this

*Twenty-sixth* Day of *March 1985*

[SEAL]

*Attest:*

DONALD J. QUIGG

*Attesting Officer* *Acting Commissioner of Patents and Trademarks*